US005496494A

United States Patent [19]

Burzio et al.

[11] Patent Number: 5,496,494

[45] Date of Patent: Mar. 5, 1996

[54] PROCESS FOR DECREASING THE BUILD UP OF INORGANIC INCRUSTATIONS ON TEXTILES AND DETERGENT COMPOSITION USED IN SUCH PROCESS

[75] Inventors: Fulvio Burzio, Milan, Italy; Roland Beck, Brussels, Belgium

[73] Assignees: Ausimont S.p.A., Milan, Italy; Cerestar Holding B.V., Sas Van Gent, Netherlands

[21] Appl. No.: 218,213

[22] Filed: Mar. 25, 1994

[30] Foreign Application Priority Data

Mar. 30, 1993 [EP] European Pat. Off. ..... 93105232

[51] Int. Cl.[6] ..... C11D 17/00; C11D 17/04

[52] U.S. Cl. ..... 252/174.17; 252/174.18; 252/DIG. 2; 252/DIG. 15

[58] Field of Search ..... 252/174.17, 174.18, 252/DIG. 2, DIG. 15

[56] References Cited

U.S. PATENT DOCUMENTS

| | | | |
|---|---|---|---|
| 3,592,774 | 7/1971 | Altenschöpfer | 252/174.17 |
| 3,721,633 | 3/1973 | Ranauto | 252/174.17 |
| 3,773,674 | 11/1973 | Adam et al. | 252/99 |
| 3,821,118 | 6/1974 | Finck | 252/99 |
| 4,695,284 | 9/1987 | Hight | 8/137 |
| 4,732,696 | 3/1988 | Urfer | 252/174.17 |
| 4,755,318 | 7/1988 | Davies et al. | 252/109 |
| 5,047,165 | 9/1991 | Lysy et al. | 252/174.18 |
| 5,047,168 | 9/1991 | Broze et al. | 252/174.17 |

FOREIGN PATENT DOCUMENTS

| | | | |
|---|---|---|---|
| 0215637 | 3/1987 | European Pat. Off. | C11D 11/02 |
| 0307748 | 3/1989 | European Pat. Off. | C11D 3/22 |
| 531040 | 5/1967 | Germany | C11D 3/22 |
| 8112123 | 5/1975 | Japan | C11D 1/66 |
| 2125813 | 3/1984 | United Kingdom | C11D 1/62 |

OTHER PUBLICATIONS

Laid Open Patent Gazette No. 87–288697 (Dec. 1987).
Chem. Abstract, vol. 99, No. 4, Abstract No. 24452.
Chem. Abstract, vol. 107, No. 10, Abstract No. 79987 13 Mar. 1987; 5 Sep. 1985.
Chem. Abstract, vol. 103, No. 14, Abstract No. 106643 17 May 1985; 21 Oct. 1983.
Chem. Abstract, vol. 88, No. 6, Abstract No. 39259 08 Aug. 1977; 03 Feb. 1976.
Chem. Abstract, vol. 99, No. 4, Abstract No. 24452 23 Dec. 1982; 19 Jun. 1981.

*Primary Examiner*—Paul Lieberman
*Assistant Examiner*—Patricia Hailey
*Attorney, Agent, or Firm*—Bryan Cave

[57] ABSTRACT

A process for decreasing the build-up of inorganic incrustations on textiles deriving from water hardness and due to repeated washing cycles with detergent compositions comprises the addition to the washing bath of a non-reducing carbohydrate and/or non-reducing carbohydrate derivative as co-builder.

8 Claims, No Drawings

PROCESS FOR DECREASING THE BUILD UP OF INORGANIC INCRUSTATIONS ON TEXTILES AND DETERGENT COMPOSITION USED IN SUCH PROCESS

The present invention relates to a process for decreasing the build-up of inorganic incrustations on fabrics deriving from water hardness and due to repeated washing cycles with detergent compositions.

More particularly, the present invention relates to a process for decreasing the build-up of inorganic incrustations wherein a co-builder is added to the washing cycle, and to detergent and/or antiincrustating composition containing said co-builder.

It is well known that detergents contain builders in order to support detergent action and to eliminate calcium and magnesium ions (hardness ions), which arise partly from the water and sometimes also from soil and fabrics.

In case of multiple washing cycles the washing performance significantly reduces because of the build up of inorganic incrustations on fabrics and on washing machine components. Such build up of inorganic incrustations on fabrics decreases the flexibility of fibres and consequently shorten the fabric life, in addition to greying the tissue.

A well known builder is the sodium tripolyphosphate which has excellent properties in the washing process even at low concentrations. Despite its many advantageous properties, it causes serious ecological problems, namely eutrophication of standing or slowly flowing surface waters leading to extreme algal growth which adversely influences marine organisms. Therefore, the use of phosphate free detergents is of great importance.

Some substitutes of phosphate builders such as zeolites have been adopted. However, zeolites alone in water softening have poor efficiency. Therefore, good antiincrustating effects are achieved only in the presence of auxiliary compounds called co-builders.

The most widely used co-builders are synthetic polymers and/or co-polymers of olefinic mono- or dicarboxylic acids such as acrylic and maleic acid and copolymers of said monomers with other allylic or vinylic monomers. The common characteristic of these polymeric materials is their minimal biodegradability which leads to ecological problems.

There are known other non-polymeric co-builders, such as EDTA (ethylenediaminetetraacetic acid sodium salt), NTA (nitrilotriacetic acid sodium salt) and phosphonates. Like the polymeric co-builders these substances too are non-biodegradable.

It is therefore an object of the present invention to provide a process for decreasing the build-up of inorganic incrustations on fabrics and on washing machine components by using co-builders which are very efficient in reducing incrustation build up during washing cycles and which are cheap and biodegradable.

Another object of the present invention is to provide detergent and/or antiincrustating compositions containing said biodegradable co-builders.

It has surprisingly been found that carbohydrates and carbohydrate derivatives (carbohydrate derived polyols) show a high efficiency in reducing incrustation build up when combined with detergents, particularly with zeolite-based detergents.

In accordance with one aspect of the present invention, there is provided a process for decreasing the build-up of inorganic incrustations on fabrics and on washing machine components during multiple washing cycles with detergent compositions characterized by the addition to the washing cycle of a co-builder based on non-reducing carbohydrates and/or non-reducing carbohydrate derivatives.

The co-builders based on non-reducing carbohydrates and the non-reducing carbohydrate derivatives can be incorporated into the detergent compositions or added as such directly to the washing bath.

The co-builders used according to the present invention are preferably non-reducing di-, tri- or oligo-saccharides and/or hydrogenated mono-, di- or oligo-saccharides.

Representative examples of non-reducing carbohydrates include sucrose, trehalose, kestoses, raffinose, stachyose, verbascose, nystose, inulin, and mixtures thereof.

Representative examples of non-reducing carbohydrate derivatives include glycerol, erythritol, threitol, xylitol, arabitol, ribitol, sorbitol, mannitol, galactitol, tallitol, allitol, altritol, iditol, gulitol, heptitols, anhydrohexitols, maltitol, lactitol, maltotritol, palatinit, alkyl glucosides, alkyl-polyglucosides, hydrogenated leucrose, hydrogenated glucose syrup, hydrogenated maltose syrup, hydrogenated invert sugar, hydrogenated high fructose syrups, and mixtures thereof.

The cobuilders are preferably the so-called sugar alcohols, particularly sugar alcohols having the general formula $HOCH_2(CHOH)_nCH_2OH$ where n has a value from 2 to 5 inclusive. Particularly preferred are the hexitols specially sorbitol or mannitol. Mixtures of sugar alcohols may also be used e.g. mixtures of sorbitol and mannitol and mixtures known as hydrogenated starch hydrolysates which contain sorbitol, maltitol, maltotriitol and higher oligomers.

The co-builders preferably are hexitols, such as sorbitol and/or mannitol; or sucrose and/or glycerol.

In accordance with another aspect of the present invention, there are provided detergent and/or antiincrustating compositions containing the hereinbefore defined co-builders. These compositions may also contain usual components such as anionic, non-ionic, cationic or amphoteric surfactants, alkali metal salts (e.g. sodium carbonate, sodium silicate), neutral salts (e.g. sodium sulphate), zeolite, bleaching agents, bleaching activators and minor ingredients.

In accordance with one preferred embodiment of the present invention the co-builders are used in combination with zeolite-based detergents.

The co-builders used according to the present invention are particularly efficacious in the presence of inorganic persalts, such as sodium perborate tetrahydrate or monohydrate.

The amount of the co-builders used in the process can vary from 1 g/washing cycle to 40 g/washing cycle, and preferably from 2 g/washing cycle to 20 g/washing cycle. This amount is comprised within the range of from 0,5% to 20% and preferably comprised within the range of from 1% to 10%, expressed as 100% dry substance of the detergent or antiincrustating compositions.

The co-builders used according to the present invention are naturally derived, biodegradable compounds. In combination with detergents they reduce the build up of inorganic incrustations on fabrics and on washing machine components. Such activity is more significant at high temperatures e.g. at 90° C.

The present invention is disclosed in still further detail in the following examples, which are supplied for purely illustrative and not limiting purposes.

EXAMPLE 1

The anti-incrustation test was carried out running 25 cycles in automatic machines under the following conditions:

washing program at 60° C., linen load: 3 kg cotton ballast (white and clean)/washing cycle, dosage of detergent composition without co-builder: 192 g/washing cycle, water hardness: 45° F. (Ca:Mg =3:1).

As test fabric for incrustation build-up detection a white, non optically brightened cotton sheet of 50 cm×50 cm was used. The sheet was previously desized and had the following characteristics: weight=180 g/m$^2$, warp=24 yarns, weft=24 yarns.

Three commercial washing machines of Italian market of CANDY, ARISTON and S. GIORGIO were used in the antiincrustation test.

The test fabric was consecutively washed in these washing machines by changing the washing machine after every 5th washing cycle, to avoid systematic errors.

At the end of the 25th washing cycle a 10 cm×50 cm strip was cut off from the test fabric, dried in an oven at 60° C. for 4 hours and weighed.

Then it was burnt and calcined at 900° C. in a muffle. The residue after calcination, expressed as % of the strip weight, represented the % of inorganic incrustation.

The detergent composition (without co-builder) used for the test and assumed as a reference, was the following:

| | |
|---|---|
| surfactants (anionic + non-ionic + soap) | 14% |
| zeolite 4A | 27% |
| sodium silicate | 3% |
| sodium carbonate | 10% |
| sodium perborate tetrahydrate | 20% |
| sodium sulphate | 26% |

As co-builder sorbitol was used at the level of 6 g/washing cycle.

The inorganic incrustation build up determined after the 25th washing cycle is set forth in Table 1.

For comparative purposes the same test was repeated at 60° C. and at 90° C. with the difference that no co-builder was added to the washing cycles. The results obtained are reported in Table 1.

EXAMPLE 2

Example 1 was repeated with the difference that the washing cycles were carried out at 90° C.

The inorganic incrustation build up determined after the 25th washing cycle is reported in Table 1.

The test results of Examples 1 and 2 show that the use of sorbitol in the washing reduces the build up of inorganic incrustation on the fabric and this reduction is more significant at 90° C.

EXAMPLE 3

Example 1 was repeated with the difference that sorbitol was replaced by mannitol and it was used in an amount of 2 g/washing cycle.

The determined inorganic incrustation build up is reported in Table 1.

EXAMPLE 4

Example 3 was repeated with the difference that the washing cycles were carried out at 90° C.

The determined inorganic incrustation build up is reported in Table 1.

EXAMPLE 5

Example 4 was repeated with the difference that the mannitol amount was 8 g/washing cycle.

The obtained results set forth in Table 1 show that the increase in the amount of mannitol contributes to a more significant decrease in the inorganic incrustation build up.

EXAMPLE 6

Example 5 was repeated with the difference that mannitol was substituted by an equal amount of sucrose.

The determined inorganic incrustation build up is reported in Table 1.

EXAMPLE 7

Example 5 was repeated with the difference that mannitol was substituted by an equal amount of glycerol.

The values obtained for inorganic incrustation build up and reported in Table 1 demonstrate that the co-builders based on carbohydrates and carbohydrate derivatives show excellent antiincrustating properties in combination with detergents.

TABLE 1

| Co-builder | Dosage g/wash | Incrustation in % 60° C. | Incrustation in % 90° C. |
|---|---|---|---|
| absent (reference) | — | 1,9 | 3,9 |
| Sorbitol (Examples 1 and 2) | 6 | 1,1 | 1,8 |
| Mannitol (Examples 3 and 4) | 2 | 1,5 | 1,4 |
| Mannitol (Example 5) | 8 | — | 0,86 |
| Sucrose (Example 6) | 8 | — | 1,1 |
| Glycerine (Example 7) | 8 | — | 1,3 |

We claim:

1. In a process for decreasing the build-up of inorganic incrustations on fabrics and on washing machine components during multiple fabric washing cycles carried out by a detergent composition comprising surfactants, an inorganic persalt, and a zeolite builder, the improvement comprising the addition to the washing cycle of a combination of the detergent composition with a co-builder selected from the group consisting of non-reducing or hydrogenated sugar alcohols having the general formula $HOCH_2(CHOH)_nCH_2OH$, where n has a value from 2 to 5.

2. The process of claim 1, wherein the co-builder is a hexitol.

3. The process of claim 2, wherein the co-builder is selected from the group consisting of sorbitol, mannitol, and mixtures thereof.

4. The process of claim 1, wherein the co-builder is added directly to the washing bath.

5. The process of claim 4, wherein the co-builder is added in an amount from 1 to 40 grams per washing cycle.

6. The process of claim 5, wherein the co-builder is added in an amount from 2 to 20 grams per washing cycle.

7. The process of claim 1, wherein the co-builder is incorporated into the detergent composition.

8. In a process for decreasing the build-up of inorganic incrustations on fabrics and on washing machine components during multiple fabric washing cycles carried out by a detergent composition comprising surfactants, an inorganic persalt, and a zeolite builder, the improvement comprising the addition to the washing cycle of a combination of the detergent composition with sucrose as a co-builder.

* * * * *